United States Patent [19]

Cooper, Jr. et al.

[11] Patent Number: 4,590,991

[45] Date of Patent: May 27, 1986

[54] FLEXIBLE STABILIZER FOR DEGRADED HEAT EXCHANGER TUBING

[75] Inventors: Frank W. Cooper, Jr., Monroeville; Thomas M. Epperson, Penn Township, Lancaster County; Gregory L. Calhoun, Allegheny Township, Armstrong County; Harvey D. Kucherer, Monroeville, all of Pa.

[73] Assignee: Westinghouse Electric Corp., Pittsburgh, Pa.

[21] Appl. No.: 569,078

[22] Filed: Jan. 9, 1984

[51] Int. Cl.[4] ..... F28F 7/00

[52] U.S. Cl. ..... 165/69; 122/32; 122/DIG. 14; 138/91; 165/71; 165/76

[58] Field of Search ..... 165/69, 71, 76, 109 T, 165/134 R, 137; 138/38, 91, 89, 108; 122/32, 34, 33, 235 C, DIG. 14

[56] References Cited

U.S. PATENT DOCUMENTS

| | | | |
|---|---|---|---|
| 206,998 | 8/1878 | Baker | 138/38 X |
| 282,006 | 7/1883 | Morgan | 138/91 |
| 509,678 | 11/1893 | Pollard | 138/91 |
| 789,620 | 5/1905 | Mason | 138/91 |
| 2,394,831 | 2/1946 | Woods | 138/91 X |
| 2,908,295 | 10/1959 | Beazley | 138/108 X |
| 3,802,491 | 4/1974 | Plank, Jr. et al. | 165/133 X |
| 4,069,573 | 1/1978 | Rogers, Jr. et al. | 29/421 R |
| 4,191,246 | 3/1980 | Cassell | 165/162 X |
| 4,290,543 | 9/1981 | Larson | 138/89 X |
| 4,307,754 | 12/1981 | Muratsubaki | 138/108 |
| 4,352,379 | 10/1982 | Larson | 138/89 X |
| 4,368,571 | 1/1983 | Cooper, Jr. | 29/421 R |
| 4,369,662 | 1/1983 | Rieben et al. | 29/522 R X |
| 4,390,042 | 6/1983 | Kucherer et al. | 138/89 |

FOREIGN PATENT DOCUMENTS

| | | | |
|---|---|---|---|
| 2364 | of 1889 | United Kingdom | 138/91 |
| 13259 | of 1905 | United Kingdom | 138/91 |
| 10818 | of 1908 | United Kingdom | 138/91 |
| 10136 | of 1913 | United Kingdom | 138/91 |

*Primary Examiner*—Sheldon J. Richter
*Assistant Examiner*—Randolph A. Smith
*Attorney, Agent, or Firm*—D. M. Satina

[57] ABSTRACT

A flexible vibration stabilizer and method for reducing vibration in a tube in a shell and tube heat exchanger wherein the stabilizer is an elongated flexible cable or chain which may have a plurality of rigid members loosely or fixedly mounted thereon. A plug may be used for simultaneously mounting the stabilizer to the tube and for sealing same.

15 Claims, 6 Drawing Figures

FLEXIBLE STABILIZER FOR DEGRADED HEAT EXCHANGER TUBING

BACKGROUND OF THE INVENTION

This invention relates to vibration stabilizers and more particularly to apparatus for reducing the vibration of a tube within a tube bundle in a shell and tube heat exchanger.

A typical nuclear steam generator comprises a vertically oriented shell, a plurality of U-shaped tubes disposed in the shell so as to form a tube bundle, a tube sheet for supporting the tubes at the ends opposite the U-like curvature, and a dividing plate that cooperates with the tube sheet forming a primary fluid inlet plenum at one end of the tube bundle and a primary fluid outlet plenum at the other end of the tube bundle. The area below the tube sheet formed by the inlet and outlet plenums is the channel head where some of the repair and maintenance work on the steam generator is performed.

The primary fluid having been heated by circulation through the nuclear reactor core enters the steam generator through the primary fluid inlet plenum. From the primary fluid inlet plenum, the primary fluid flows upwardly through first openings in the U-tubes near the tube sheet which supports the tubes, through the U-tube curvature, downward through the second openings in the U-tubes near the tube sheet, and into the primary fluid outlet plenum. At the same time, a secondary fluid known as feed water, is circulated around the U-tubes in heat transfer relationship therewith, thereby transferring heat from the primary fluid in the tube into the secondary fluid surrounding the tubes causing a portion of the secondary fluid to be converted to steam. The primary fluid generally flows at a velocity which is low enough such that little or no vibration of the tubes results therefrom; however, the velocity of the secondary fluid or feed water is such to induce unwanted vibration into the tubes resulting in problems hereafter discussed.

Since the primary fluid contains radioactive particles and is isolated from the secondary fluid by the U-tube walls and the tube sheet, it is important that the U-tubes and the tube sheet be maintained defect-free so that no breaks will occur in the U-tubes or in the welds between the U-tubes and the tube sheet thus preventing contamination of the secondary fluid by the primary fluid.

Although in some steam generators, the tubes are not U-shaped but straight, both types of tube bundles in steam generators are subjected to the above set forth flow induced vibration due to the velocity of the secondary fluid or feed water across the tube bundle. Therefore, when tubes in the tube bundle degrade due to corrosion and wear and perhaps due to the flow induced vibration, it is necessary not only to plug the degraded tubes in order to prevent contamination of the secondary fluid by the primary fluid but also to control or reduce the vibration in the degraded tubes to prevent the degraded tubes from coming in contact with the adjacent usable tubes leading to unexpected degradation of additional tubes.

Prior attempts to diminish the vibration of degraded tubes involved the use of rigid sleeves or rods positioned inside the degraded tubes or in some cases barstock connected to the tube. In general, it has been believed that if the natural frequency of the tube can be raised above the frequency of the induced vibration produced by the feed water, then the vibration of the degraded tube would lessen. Since stiffening the tube raises the natural frequency of the tube but adding mass to the tube lowers the natural frequency of the tube, it has always been thought that the most efficacious method to reduce vibration was one which added the maximum amount of stiffness with the least amount of mass. Accordingly, rigid sleeves or rods have been used heretofore.

Because the channel head is a relatively small area and the place from which rods, sleeves or the like must be inserted, prior devices have required installation of the inserts in small sections by threading individual sections of tubes or rods in the channel head in order to construct an insert of desired length and then finally welding the end of the insert to the tube end to seal same. Such a construction could take as long as ten minutes per tube and in the case of a tube bundle having 7,000 tubes of which several hundred may have to be plugged, it can be seen that a significant amount of radiation exposure to maintenance personnel resulted from prior art methods and apparatus for reducing tube vibration.

What is needed is a vibration stabilizer for degraded tubes within a tube bundle in a shell and tube heat exchanger which is effective to reduce vibration of degraded tubes but at the same time is installed quickly, thereby reducing radiation exposure to maintenance personnel.

SUMMARY OF THE INVENTION

A flexible vibration stabilizer and method for reducing vibration in a degraded tube which includes a flexible member which may carry a plurality of rigid members thereon inserted into the degraded tube to provide nominal clearance between the flexible member or the flexible member and the rigid members carried thereby and the adjacent tube wall wherein vibration is reduced by mechanical interaction between the flexible member or the rigid members carried thereby and the adjacent tube wall.

Accordingly, it is an object of the invention to provide a flexible vibration stabilizer for a tube in a shell and tube heat exchanger comprising an elongated flexible member and means for mounting the member in the associated tube, whereby the elongated flexible member positioned inside the tube reduces tube vibration by mechanical interaction between the flexible member and the tube.

Another object of the invention is to provide a flexible vibration stabilizer of the type set forth wherein a plurality of rigid members are carried by the flexible member.

A still further object of the invention is to provide a method of decreasing the vibration of a tube in a shell and tube heat exchanger comprising inserting an elongated flexible member into the tube.

Yet another object of the present invention is to provide a method of the type set forth in which the elongated flexible member carries a plurality of rigid members fixedly mounted at spaced apart intervals along the flexible member.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
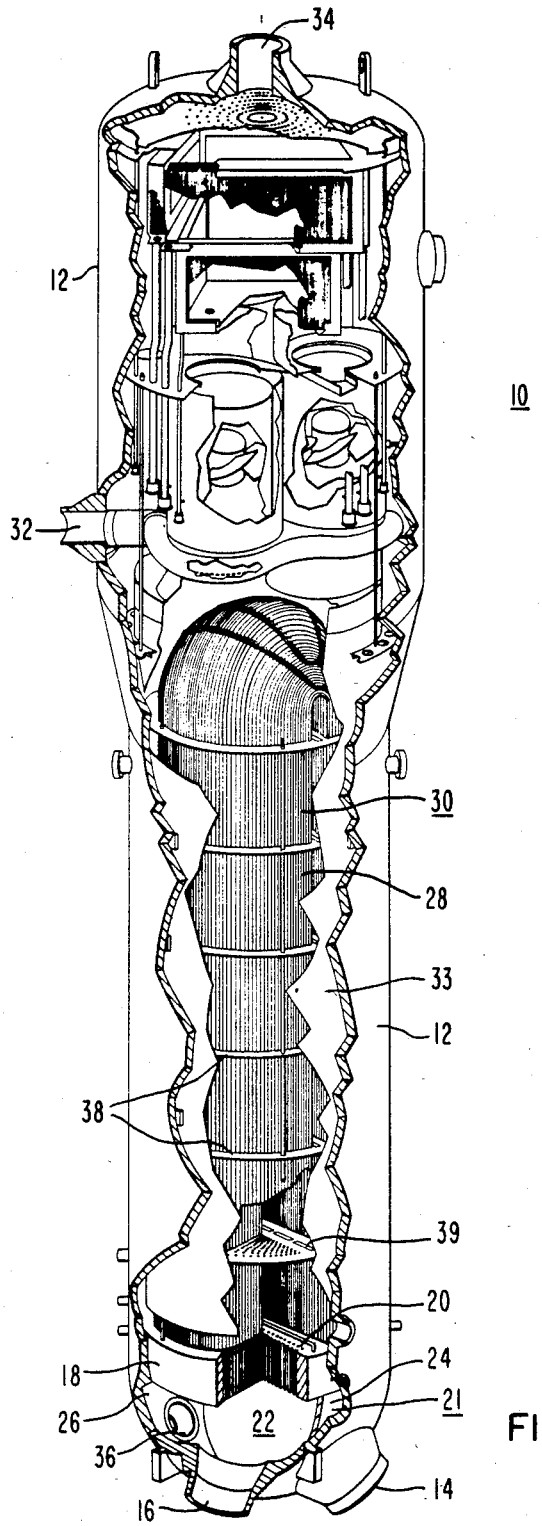
FIG. 1 is a partial cross-sectional view in elevation of a typical steam generator.

Referring to FIG. 1, a nuclear steam generator 10 comprises an outer shell 12 with a primary fluid inlet nozzle 14 and a primary fluid outlet nozzle 16 attached near the lower end of the shell. A generally cylindrical tube sheet 18 having tube holes 20 therein is also attached to the outer shell 12 near its lower end defining therewith a channel head 21. A dividing plate 22 in the channel head 21 attached to both tube sheet 18 and the outer shell 12 divides the channel head into a primary fluid inlet plenum 24 and a primary fluid outlet plenum 26, as is well understood in the art. Tubes 28 are heat transfer tubes with a U-curvature disposed within the outer shell 12 and attached to the tube sheet 18 by means of tube holes 20. Tubes 28 which may number about 7,000 form a tube bundle 30. In addition, a secondary fluid inlet nozzle 32 is disposed in the outer shell 12 for providing a secondary fluid such as feed water while a steam outlet nozzle 34 is attached to the top of the outer shell 12 through which steam exits the generator 10. There is a tube wrapper 33 which diverts feed water flow downward through the annular space between the tube wrapper 33 and the inner surface of the outer shell 12.

Finally, there are a plurality of axially spaced apart support plates or baffles 38 which, as illustrated, have holes therein axially in registry respectively with holes 20 in tube sheet 18 thereby to provide support to the individual tubes 28 in the tube bundle 30. Larger apertures or flow slots 39 are provided in the support or baffle plates 38 to facilitate movement of secondary water through the steam generator 10.

In operation, the primary fluid which may be water having been heated by circulation through a nuclear core enters steam generator 10 through primary inlet nozzle 14 and flows into primary fluid inlet plenum 24. From the primary fluid inlet plenum 24, the primary fluid flows upwardly through the tubes 28 in the tube sheet 18, up through the U-shaped curvature of the tubes 28, down through the tubes and into the primary fluid outlet plenum 26 where the primary fluid exits the steam generator 10 through the primary fluid outlet nozzle 16. While flowing through the tubes 28, heat is transferred from the primary fluid to the secondary fluid which surrounds the tubes 28 causing some of the secondary fluid to vaporize. The resulting steam then exits the steam generator 10 through the steam outlet nozzle 34.

Due to the fact that the velocity of the secondary water entering the steam generator 10 through the secondary water inlet nozzle 32 and therefrom into the bottom of the steam generator may be sufficiently high in some areas to excite the tubes 28 beyond their normal resonating frequency, the secondary water induces the tubes 28 to vibrate. This phenomenon is termed flow induced vibration and is deleterious to the longevity of the tubes 28. Due to both corrosion and wear, as well as perhaps the vibration itself, it is necessary on occasion to remove degraded tubes 28 from service in the tube bundle 30. On the occasions when it is necessary to inspect or repair the tubes 28, the access to the channel head 21 is provided by manways 36 in the outer shell 12 so that access may be had to the entire tube sheet 18 via the fluid inlet plenum 24 and the fluid outlet plenum 26.

Figure 2:
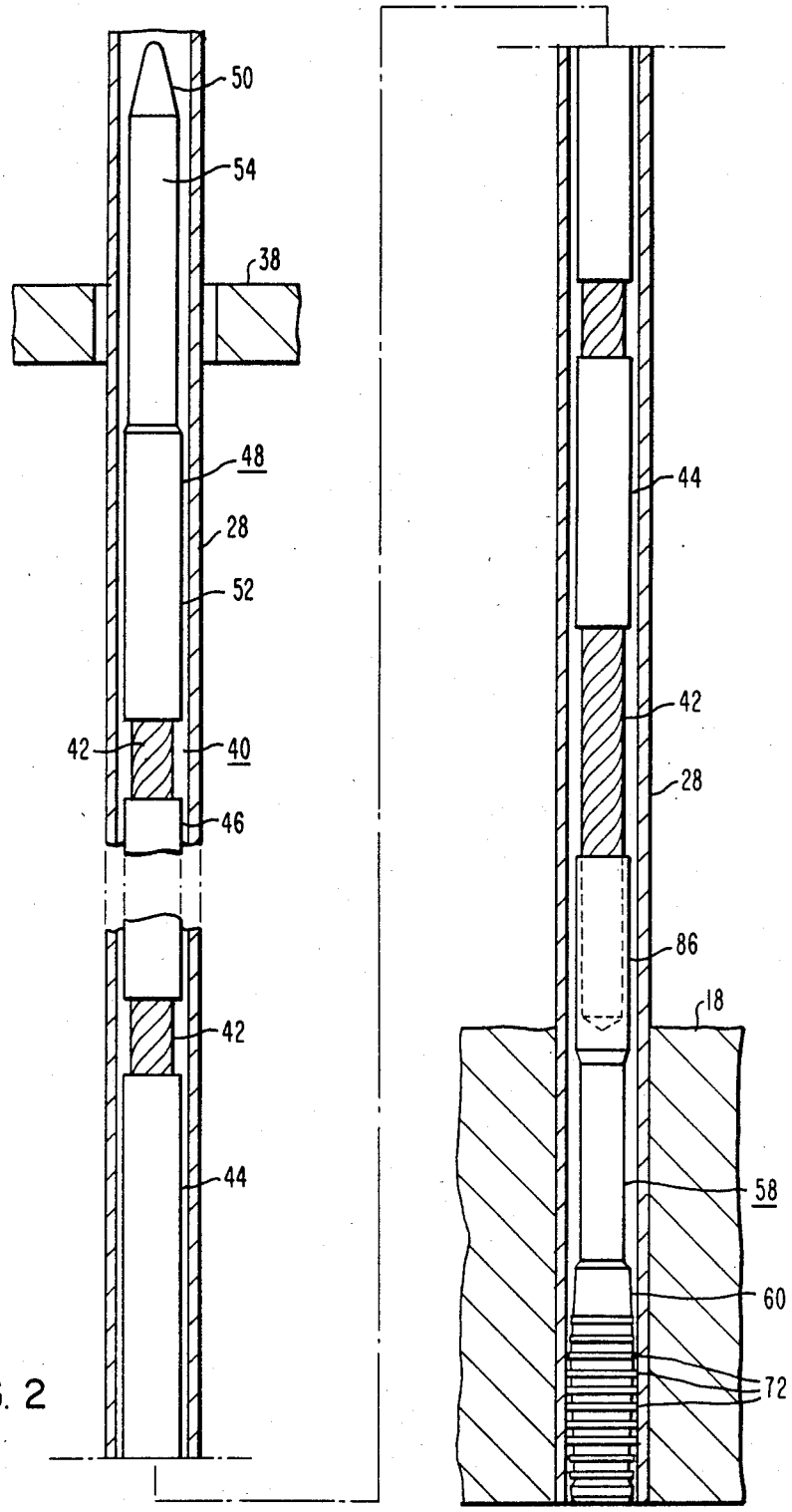
FIG. 2 is a partial cross-sectional view in elevation of a vibration stabilizer including flexible and rigid member positioned inside a degraded tube having a tube plug at one end thereof.

Referring now to FIG. 2, there is shown a flexible vibration stabilizer 40 loosely disposed within a tube 28 within the tube bundle 30, the tube 28 passing through a plurality of axially spaced apart support or baffle plates 38. The flexible vibration stabilizer 40 includes a cable 42 having a plurality of axially spaced apart rigid members or sleeves 44 secured thereto. As illustrated, there may be sleeves 44 having the same axial extent and also sleeves 46 having another axial extent. The sleeves 46 are shorter than the sleeves 44 and are provided as spacers so that the flexible vibration stabilizer 40 has a rigid member opposite each support or baffle 38. It is believed that the presence of a rigid member 44, 46 in the portion of the tube 28 passing through the support or baffle plate 38 provides some reinforcement through the tube prolonging tube life and preventing premature rupture or wear due to the presence of the support or baffle plates 38. The rigid members or sleeves 44, 46 may be fixedly secured to the cable 42 as by welding or swaging, swaging being preferred. At the free end of the cable 42 is a tip member assembly 48 comprised of a tapered or pointed end 50 and a mounting portion 52 fixedly secured to the free end of the cable 42 as by swaging or welding, there being a reduced diameter portion 54 of the tip member assembly between the mounting portion 52 and the tapered or pointed end 50.

As seen in the drawing, the flexible vibration stabilizer 40 is of sufficient length to pass beyond several of the spaced apart horizontally positioned support or baffle plates 38 in the generator 10, only one being shown for purposes of illustration.

Figure 3:
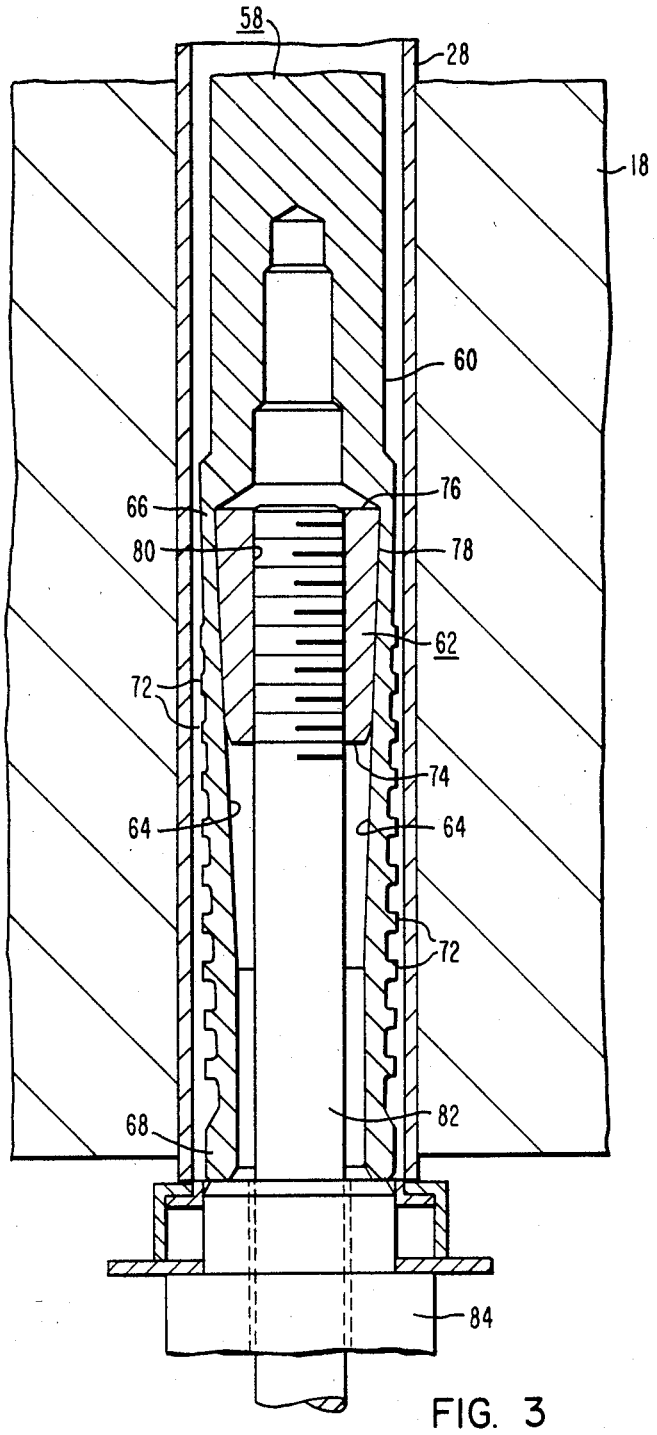
FIG. 3 is an enlarged sectional view of a tube plug of the type illustrated in FIG. 2 before the tube is sealed.
Figure 4:
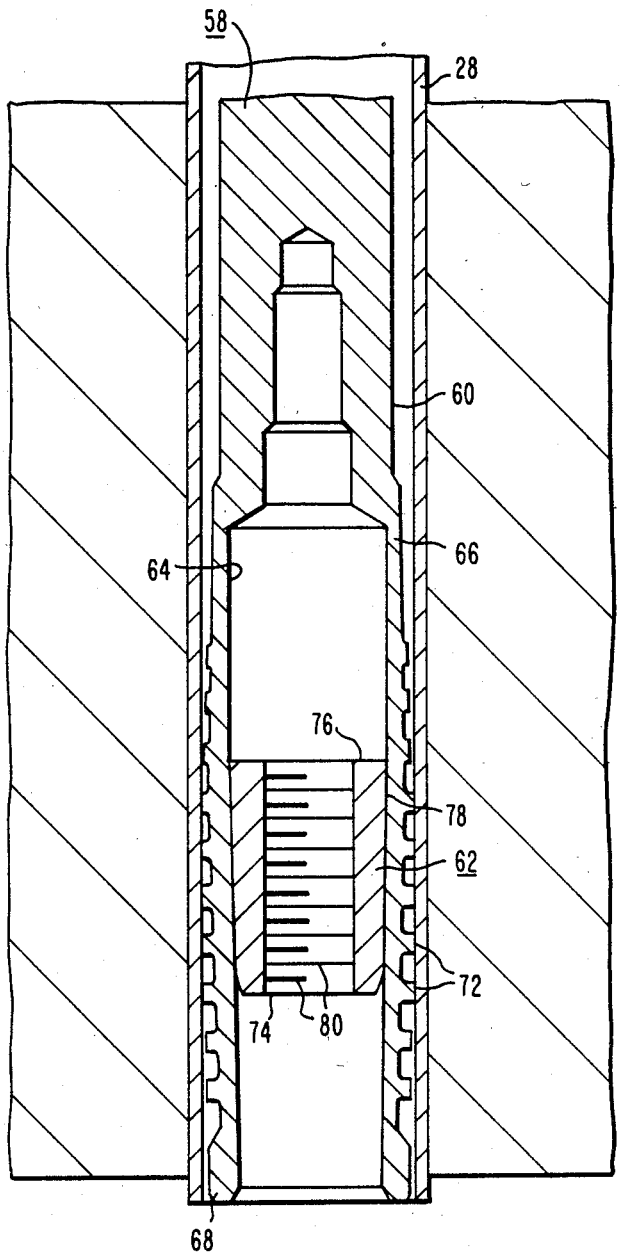
FIG. 4 is a sectional view of the tube plug illustrated in FIG. 3 after the plug has been expanded to lock it into position and seal the tube.

The cable 42 may be secured to the tube 28 by any suitable means such as a hanger or the like; however, there is illustrated a tube plug mounting and sealing means 58 positioned within the tube sheet 18. The tube plug 58 may be of the type disclosed in Kucherer et al., U.S. Pat. No. 4,390,042, issued June 28, 1983, assigned to the assignee hereof, the disclosure of which is incorporated herein by reference. The plug mounting and sealing means 58, as best seen in FIGS. 3 and 4, comprises a shell 60 and an expander member 62. The shell 60 may be a substantially cylindrical member manufactured from a metal such as Inconel. The shell 60 has a conical inner surface 64 which has a larger diameter toward the closed end 66 and a smaller diameter at the open end 68. The inner surface 64 of the expander member 62 is arranged such that the expander member is captured within the shell 60 so that movement of the expander member 62 relative to the inner surface 64 causes shell 60 to expand without allowing the expander member 62 to be removed from the shell 60.

Shell 60 has a substantially uniform wall thickness in the portion of the shell that is expanded by the expander member 62. In this portion of the shell 60, the wall thickness does not vary by substantially more than plus or minus 10 percent of the nominal wall thickness which allows for a somewhat uniform pulling force to expand the shell 60 by the expander member 62. In addition, a plurality of lands or annular rings 72 are formed on the outside surface of the shell 60 in a manner such the height of each land 72 increases from the closed end 66 to the open end 68 while the outer surfaces of all lands 72 are maintained in approximately the same external diameter. The wall thickness of the shell 60 remains substantially constant throughout the portion of the shell 60 where the lands 72 are located. The shell 60 is also constructed such that the area near the open end 68 has a thicker wall section than the remainder of the shell 60 to provide stability when extracting the plug mounting and sealing means 58.

Still referring to the FIGS. 3 and 4 of the drawing, the expander member 62 may be manufactured from a hardenable metal such as stainless steel alloy Carpenter 445 and is formed such that it has a leading end 74 which has a tangentially blended radius that minimizes the pushing of metal ahead of the expander member 62 when the expander member is pulled along the shell 60. A suitable lubricant such as graphite suspended in alcohol may be applied to the expander member 62 to aid in the sliding movement thereof. The expander member 62 may have a polished exterior surface providing enhanced movement relative to the shell 60. The expander 62 has a trailing edge or end 76 which is formed with a sharp edge such that it provides a self locking mechanism. The sharp edge trailing end 76 restrains the expander member 62 from moving toward the closed end 66 of the shell 60, thereby preventing inadvertent contraction of the shell 60 after expansion thereof, as hereinafter explained. The expander member 62 has a conical outer surface 78 that is arranged such that its outside diameter is smaller near the leading edge 74 and larger near the trailing edge 76. The shape of the outer surface 78 provides a mechanism for expanding the shell 60 when the expander member 62 is moved relative to the shell. The expander member 62 has internal threads 80 which can be used for gripping the expander member 62 during the expansion process. The plug mounting and sealing means 58 has a mounting portion 86, as seen in FIG. 2, which is fixedly mounted to the flexible cable 42 such as by swaging.

Operation of the flexible vibration stabilizer 40 is as follows, the plug mounting and sealing means 58 and particularly the expander member 62 thereof is an internally threaded surface 80 which mates with external threads on a draw bar 82 of a hydraulic cylinder 84. When the plug mounting and sealing means 58 is thus mounted, as shown in FIG. 3, the workman can insert the entire flexible vibration stabilizer 40 into the associated tube 28 easily notwithstanding the cramped space available in the channel head 21. Specifically, the cable 42 is fed into the tube 28 until the plug mounting and sealing means 58 is in the position shown in FIG. 3. At this time, as is schematically illustrated in FIG. 2, the flexible cable has extended into the tube 28 such that rigid members 44, 46 or the tip member assembly 48 is opposite to or in registry with each one of the various axially spaced apart horizontally extending support or baffle plates 38. The entire flexible vibration stabilizer 40, due to its construction, can be bent through an arc having a three foot radius, thereby facilitating feeding the stabilizer through the tubes 28.

After the flexible vibration stabilizer 40 is positioned as illustrated in FIGS. 2 and 3 with the plug mounting and sealing assembly 58 snugly fitted into the end of the heat exchanger tube 28, the hydraulic cylinder 84 is actuated to exert a force of approximately between 12,000 and 22,000 pounds which causes the draw bar 82 to be moved toward the hydraulic cylinder 84, that is away from the tube sheet 18 thereby pulling the expander member 62 relative to the shell 60 to the position illustrated in FIG. 4. After the shell 60 has been expanded, the draw bar 82 may be unthreaded from the expander member 62 and removed thereby leaving the plug and sealing member 58 in the locked or sealed position thereof. Because the primary side fluid nominally may be at 2250 psig and at 600° F., while the shell side secondary feed water will be nominally at 1,000 psig and 540° F. it is important, where working with degraded or ruptured tubes 28 to seal the pressure boundary between the shell side and the tube side to prevent the aforementioned contamination of the secondary feed water by the primary fluid.

It has been determined that significant vibration reduction or damping occurs with the insertion of any flexible member such as the cable 42 into a degraded tube 28, with or without the end tip assembly 48 and with or without any of the rigid members 44, 46 present thereon. Where only the cable 42 is loosely disposed in the associated tube 28, it is important that the size of the cable be such that nominal clearance exists between the cable external surface and the interior surface of the associated tube. By nominal clearance, it is meant that there is on the order of between about 20 and about 40 mils clearance in the tube between inside tube 28 and the exterior surface of the cable 42. These numbers are not intended to be exact upper and lower limits of the clearance, it being understood that there is a general fall off in vibration lessening characteristics as larger clearances are provided. On the other hand, if the cable 42 is too tight, then the tube 28 not only becomes stiffer which is desirable but more mass is added to the structure which results in the lowering of the vibration frequency of the tube 28 which is to be avoided. Because prior calculations were always based on frequency changes due to the concepts of added stiffness in relation to added mass, it was surprising to discover that a flexible member inserted into a degraded tube was effective significantly to reduce tube vibration in a steam generator. Further, it has been demonstrated that the flexible vibration stabilizer 40 of the present invention can be inserted into a tube 28 in 1/10th the time necessary to insert prior art vibration lessening devices.

Figure 5:
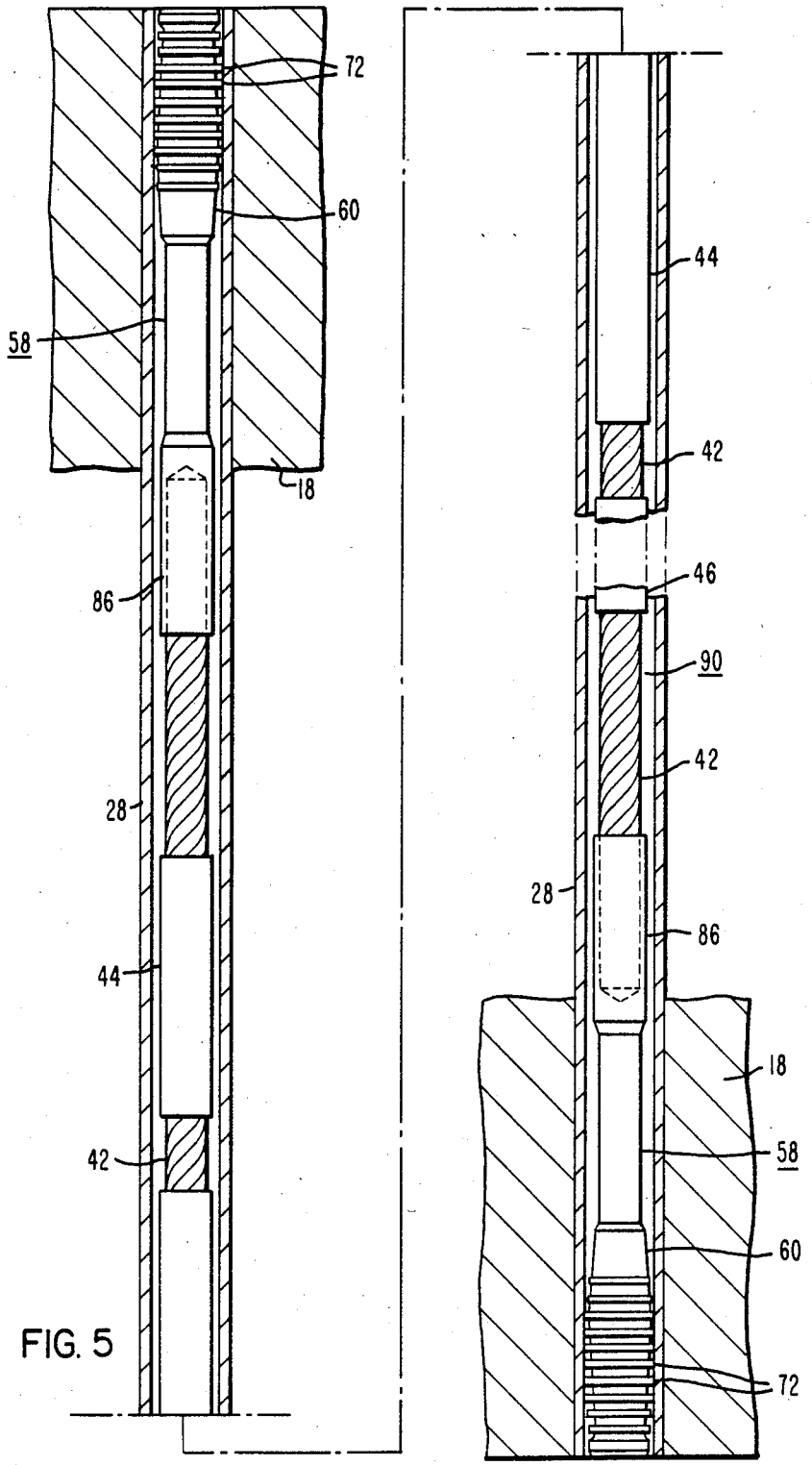
FIG. 5 is a partial cross-sectional view in elevation of a second embodiment of the invention.

In some instances, portions of the degraded tube become severed and portions may fall into the steam generator 10 and cause damage. In order to prevent portions of degraded tubing from falling into the steam generator 10, there is provided another embodiment of the present invention illustrated in FIG. 5 wherein a double plug flexible vibration stabilizer 90 is provided in order to trap any severed segments of the tube 28 and prevent same from being dislodged and falling into the steam generator 10. As illustrated, the double plug flexible vibration stabilizer 90 is provided with a cable 42 having a plurality of axially spaced apart rigid members or sleeves 44 spaced therealong and perhaps one or more smaller sleeves 46, all of which are constructed and arranged so that at least one sleeve is opposite to or in registry with an associated support or baffle plate 38 in the generator. The only difference between the embodiment of the invention 90 and the embodiment 40 previously disclosed is that in embodiment 90 there are plug sealing and mounting means 58 at both ends of the flexible cable 42, thereby to provide spaced apart sealing means along an individual tube 28. As illustrated, both plug and sealing means 58 are in the tube sheet 18, but it should be understood that where access to the tube is at places other than at the tube sheet, the plug mounting and sealing means 58 may be located at any point along the axial extent of the tube 28. Specifically, in some situations it may be desirable to cut a tube 28 along the U-shaped curved portion thereof and to insert a sealing plug and mounting member 58 at that point. Additionally, it should be pointed out that in some steam generators the tubes 28 are straight, so that the plugs 58 would always be axially spaced apart.

Figure 6:
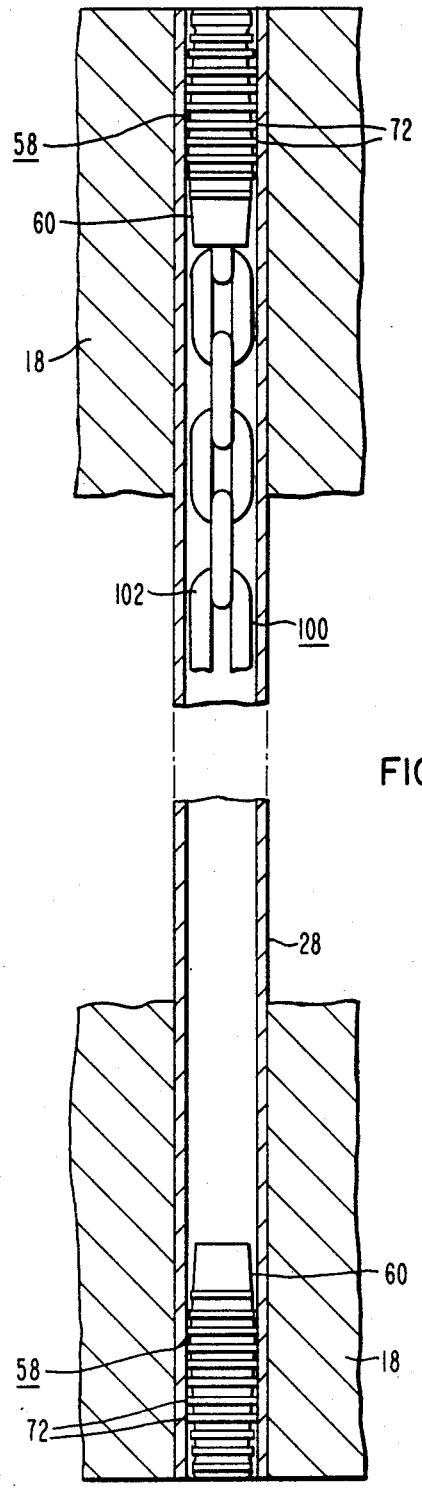
FIG. 6 is a partial cross-sectional view in elevation of another embodiment of the present invention.

Referring now to FIG. 6, there is disclosed yet another embodiment of the present invention wherein the flexible vibration stabilizer 100 includes as a flexible member thereof a chain 102. The dimension of the chain 102 is such as to provide nominal clearance between the chain wall and the associated tube 28, much in the same manner as the previously described cable 42. The chain 102 is shown without sleeves or other rigid members loosely or fixedly associated therewith, much in the same manner as the cable 42 may be used alone or in combination, as before described. The flexible vibration stabilizer 100 is shown with two spaced apart plug mounting and sealing means 58, both of these being identical to those previously described. As seen therefore, the fundamental aspect of the present invention is the provision of a flexible member 42, 102 which may be for example a cable or a chain which is disposed in a degraded tube 28 subject to excitation which causes vibration. The mechanical interaction between the flexible member 42, 102 and the adjacent or associated tube 28 reduces significantly the induced vibration in the tube due to feed water passing through the steam generator 10. The flexible member 42, 102 may or may not be provided with a plurality of rigid members 44, 46 associated therewith and these members may be loosely or fixedly disposed on the flexible member. If the rigid members 44, 46 are fixedly disposed on flexible member 42, 102, then it is preferred that they be constructed and arranged such that in operation each baffle or support plate 38 in steam generator 10 is in registry with a rigid member 44, 46, which construction may prevent premature failure of the tube 28 at the portion thereof opposite the baffle or support plate 38.

Another important aspect of the invention is the ease with which the flexible stabilizer 40 is introduced into the tubes 28 present in a tube bundle 30. The channel head 21 provides an extremely restricted area in which to work and one that is hazardous to the health of personnel due to the radioactivity present. Since the flexible vibration stabilizer 40 with or without the associated rigid members 44, 46 may be introduced into the associated tube 28 in about one minute and fixed thereto by means of any well known hanger assembly or the plug and sealing means 58 previously described, compared to the available prior art vibration reducing mechanism which requires assembly of individual segments in the channel head followed by welding or other means for securing the stabilizer in place, the subject stabilizer provides vastly reduced radiation exposure and down time. The invention also enables spaced apart plug and sealing means 58 to be used to retain in place fractured segments of a degraded tube 28 while at the same time reducing vibration to the remainder of the tube, all as hereinbefore described.

While there has been described what at present is considered to be the preferred structure and method of the present invention, it would be appreciated that various modifications and alterations may be made therein without departing from the true spirit and scope of the present invention, which scope is intended to be covered in the claims appended hereto.

What is claimed is:

1. In combination with a tube-type steam generator for a water cooled nuclear reactor, said steam generator comprising a shell member enclosing a plurality of closely spaced rigid tubes, said tubes having heated primary water flowing therethrough during normal operating conditions, said shell member during normal operating conditions having a secondary cooling flow of secondary cooling water entering therein at a high velocity and in contact with the exterior surfaces of said tubes to remove heat therefrom and to exit from said shell member as steam moving at a high velocity, the improved tube vibration stabilizer for a damaged or degraded tube comprising:

at least one stabilizer mounting device positioned at a predetermined location within said damaged or degraded tube and operable to shut off the flow of primary water through said damaged or degraded tube; and an elongated vibration stabilizer loosely mounted within said damaged or degraded tube and retained in axial position within said damaged or degraded tube by said stabilizer mounting device, said vibration stabilizer comprising an elongated flexible member which slidably extends within said damaged or degraded tube, said stabilizer being so spaced with respect to the inner wall of said damaged or degraded tube that during normal operation of said steam generator vibrations of said damaged or degraded tube will cause said vibration stabilizer to mechanically interact with said damaged or degraded tube, and the mechanical interaction between said elongated flexible member and said damaged or degraded tube surrounding said elongated flexible member operating to significantly reduce vibration in said damaged or degraded tube which can occur due to flow induced vibration caused by said secondary cooling flow.

2. The combination as specified in claim 1, wherein said elongated vibration stabilizer comprises a cable extending within said damaged or degraded tube.

3. The combination as specified in claim 1, wherein said elongated vibration stabilizer comprises a cable member, and a plurality of rigid members are disposed on said cable member with a spacing between each of said rigid members.

4. The combination as specified in claim 1, wherein said elongated vibration stabilizer comprises a chain.

5. The combination as specified in claim 1, wherein only one stabilizing mounting device is utilized to affix one end of said elongated vibration stabilizer, and the other end of said stabilizer is freely disposed in said damaged or degraded tube.

6. The combination as specified in claim 5, wherein said other end of said stabilizer is tapered or pointed to permit free insertion of said stabilizer into said damaged or degraded tube.

7. The combination as specified in claim 1, wherein two stabilizer mounting devices are utilized and are positioned in said damaged or degraded tube at spaced predetermined locations, and said elongated vibration stabilizer is retained between said stabilizer mounting devices.

8. In combination with a tube-type steam generator for a water cooled nuclear reactor, said steam generator comprising a shell member enclosing a plurality of closely spaced rigid tubes having spaced end portions, said tubes having heated primary water flowing therethrough during normal operating conditions, said shell member during normal operating conditions having a secondary cooling flow of secondary cooling water entering therein at a high velocity and in contact with the exterior surfaces of said tubes to remove heat therefrom and to exit from said shell member as steam moving at a high velocity, said tubes retained within said shell member by a series of horizontally disposed spaced baffle plates, and the spaced ends of said tubes being affixed to at least one tube sheet, the improved tube vibration stabilizer for a damaged or degraded tube comprising:

a stabilizer mounting device positioned at a predetermined location with respect to said damaged or degraded tube and operable to shut off the flow of primary water through said damaged or degraded tube; and an elongated vibration stabilizer loosely mounted within said damaged or degraded tube and retained in axial position within said damaged or degraded tube by said stabilizer mounting device, said vibration stabilizer comprising an elongated flexible member which slidably extends within said damaged or degraded tube for a sufficient distance to pass beyond at least several of said horizontally disposed baffle plates, said stabilizer being so spaced with respect to the inner wall of said damaged or degraded tube that during normal operation of said steam generator vibration of said damaged or degraded tube will cause said vibration stabilizer to mechanically interact with said damaged or degraded tube, and the mechanical interaction between said elongated flexible member and said damaged or degraded tube surrounding said elongated flexible member operating to significantly reduce vibration in said damaged or degraded tube which can occur due to flow induced vibration caused by said secondary cooling flow.

9. The combination as specified in claim 8, wherein said stabilizer mounting device is positioned within said damaged or degraded tube in predetermined location which is surrounded by said tube sheet.

10. The combination as specified in claim 8, wherein said elongated vibration stabilizer comprises a cable extending within said damaged or degraded tube.

11. The combination as specified in claim 8, wherein said elongated vibration stabilizer comprises a cable member, and a plurality of rigid members are disposed on said cable member with a spacing between each of said rigid members.

12. The combination as specified in claim 8, wherein said elongated vibration stabilizer comprises a chain.

13. The combination as specified in claim 8, wherein the free end of said stabilizer is freely disposed in said damaged or degraded tube.

14. The combination as specified in claim 13, wherein said free end of said stabilizer is tapered or pointed to permit free insertion of said stabilizer into said damaged or degraded tube.

15. The combination as specified in claim 8, wherein a second stabilizer mounting device is utilized and is positioned in said damaged or degraded tube at a spaced predetermined location, and said elongated vibration stabilizer is retained between said stabilizer mounting devices.

* * * * *